United States Patent [19]

Ruser

[11] 4,420,275

[45] Dec. 13, 1983

[54] ALASKAN OFFSHORE DRILLING BASE

[75] Inventor: John R. Ruser, Houston, Tex.

[73] Assignee: Shell Oil Company, Houston, Tex.

[21] Appl. No.: 369,715

[22] Filed: Apr. 19, 1982

[51] Int. Cl.[3] ..... E02B 17/00; E02B 3/12

[52] U.S. Cl. ..... 405/217; 405/18; 405/15

[58] Field of Search ..... 405/217, 211, 15–19, 405/32

[56] References Cited

U.S. PATENT DOCUMENTS

| | | | |
|---|---|---|---|
| 1,253,209 | 1/1918 | Chenoweth | 405/18 |
| 2,295,422 | 9/1942 | Neely et al. | 405/19 |
| 3,374,635 | 3/1968 | Crandall | 405/18 |
| 3,990,247 | 11/1976 | Palmer | 405/16 |
| 4,102,137 | 7/1978 | Porraz et al. | 405/18 |

FOREIGN PATENT DOCUMENTS

| | | | |
|---|---|---|---|
| 1066900 | 11/1979 | Canada | 405/217 |
| 1417479 | 12/1975 | United Kingdom | 405/16 |

*Primary Examiner*—Dennis L. Taylor

[57] ABSTRACT

A man-made sand and gravel island for Alaskan oil drilling operations, the sides of the island being covered with a porous fabric anchored in place by a layer of heavy (3-ton) sand bags arranged in an imbricated manner between the high and low water levels on the island.

1 Claim, 9 Drawing Figures

FIG. 4
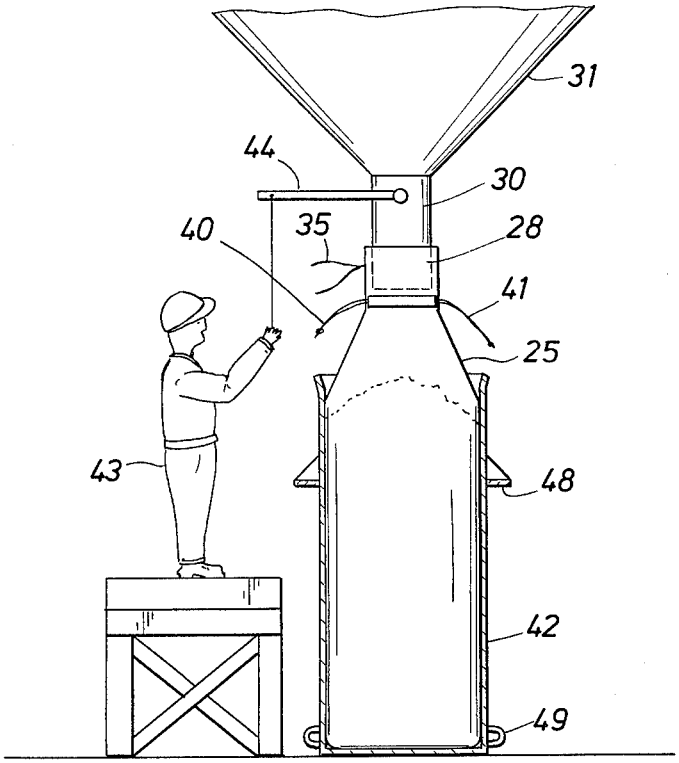
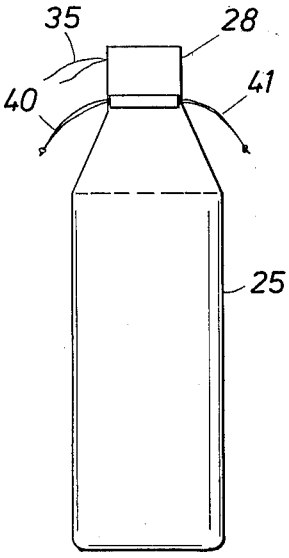
FIG. 5
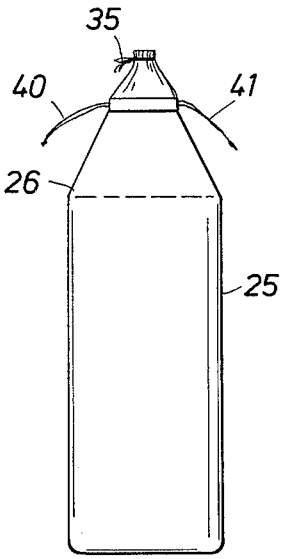
FIG. 6
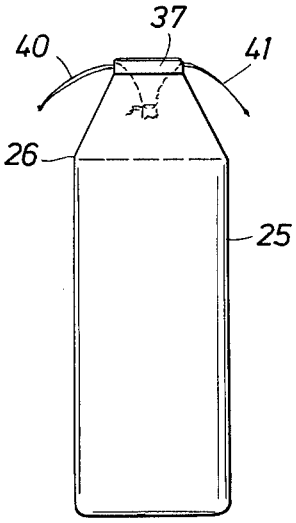
FIG. 7
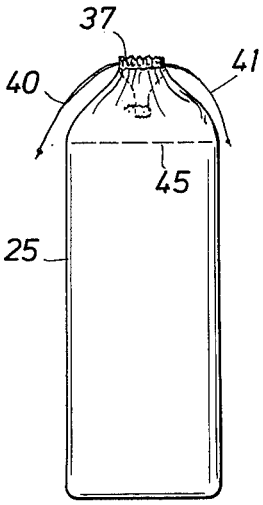
FIG. 8

ALASKAN OFFSHORE DRILLING BASE

BACKGROUND OF THE INVENTION

This invention relates to an Alaskan offshore drilling base from which oil and gas wells may be drilled. Difficulties are encountered in building any type of an offshore base due to the rough terrain, cold weather, and lack of manufacturing facilities. It is extremely difficult to build a steel offshore platform and transport it to a location offshore the North Slope of Alaska. Ice islands have been suggested but man-made islands in shallow water locations have been found to be the most practical.

The construction of man-made islands in shallow water locations is made difficult by the lack of materials that may be used. It is impractical to make an island out of concrete due to the lack of any adequate supply of cement. The cost and difficulty of transporting large quantities of cement hundreds or thousands of miles at the severe temperatures encountered in Alaska rule out cement as an island-building material. To date, the greatest success has been encountered in building man-made islands or artificial drilling bases out of sand and gravel which is readily available. Thus, sand and gravel drilling islands have been constructed by barging the material on shallow barges to the offshore location at which the island is to be built. There, the sand and gravel mixture is deposited at the selected location and the barging operation is continued until an island of suitable size has been constructed.

Alternatively, an island for drilling operations may be constructed during winter weather by trucking sand and gravel from shore to the offshore location. Generally, water is sprayed on the road over the ice so as to build up the thickness of the ice to about ten feet so as to support the weight of large trucks carrying 30 to 40 cubic yards of sand and gravel. The trucks dump the sand and gravel at a selected location where a hole has been drilled in the ice and a bulldozer pushes the sand and gravel through the hole until an island is built up below the ice. When the island is finally built up and fills the hole, the ice is cut out and the hole enlarged until the top of the island has been extended to the desired diameter, say, 200 to 500 feet. Also, the island is built up to a height of 15 to 35 feet above the high water level, depending upon the height of the waves and the severity of the storms that may be anticipated. Sufficient additional sand and gravel are added to the size of the island until the desired angle of the sloping sides of the island has been achieved. The sloping sides of the island are then preferably smoothed down in any suitable manner well known to the construction trade.

SUMMARY OF THE INVENTION

It is quite apparent that artificial drilling bases or man-made islands constructed of sand and gravel are subject to wave and wind forces during the summer months and are subject to the destructive impact of floating ice or ice floes during some seasons of the year. In order to prevent anticipated erosion of the sand and gravel island due to wave, wind, and ice action, the sloping sides of the island are preferably covered with a flexible material which may be in the form of woven cloth. The cloth is preferably made of a plastic material, such as polypropylene, which has been found to be resistant to the elements encountered. A cloth or fabric material is preferably employed so that water can pass through the cloth. Thus, at low tide, any water entrapped in the interstices of the sand and gravel may drain outwardly through the fabric covering. In the event that a fabric is not used, the flexible plastic sheets employed to cover the sloping sides of the island may be perforated.

In order to hold the perforated plastic material or fabric on the surface of the island, suitable anchoring means are employed. Large bags of sand containing from one to five cubic yards of sand and gravel each have been found to be excellent anchors. These gravel bags are preferably made of a porous synthetic fabric having sufficient strength to withstand the rough handling encountered in positioning the sand bags on the island. The bags are laid end to end on the sloping sides of the island with the long axis of the sand bag lying parallel to the downwardly sloping side of the island. The weight of the bag of gravel selected is governed by the angle of the slope, the size of the island and the anticipated height of incoming waves. It is known that the weight of the sand bag used is directly proportional to the wave height taken to the third power and is inversely proportional to the cotangent of the slope of the island.

Since at certain wave heights the action of water and/or ice dislodges some of the sand bags, it is an object of this invention to arrange all of the bags on an island lying between high and low water levels in an imbricated manner with the downslope end of each bag overlapping and anchoring the upslope end of the adjacent bag lying downhill thereof. Tests have shown that there is a much lower rate of sand bag dislodgement when this selected portion of bags are laid down in an overlapping manner. The overlap of the end of one bag over the other may be as much as 20 to 60 percent. With an overlap of about 50 percent, it has been found in tests that the anchoring sand bags can withstand waves that are 50 percent higher without becoming dislodged in greater numbers.

Another object of the present invention is to provide a man-made sand and gravel drilling base or island which can exist in the harsh environment of the Alaskan waters so as to serve as a base for drilling one or more oil and gas wells.

A further object of the present invention is to provide a flexible bag for sand and gravel capable of handling several tons of material and being provided within each closure means so that the bag can be closed in a manner so as to prevent the loss of the contained material therefrom.

BRIEF DESCRIPTION OF THE DRAWING

These and other objects and advantages of this invention will become apparent from the description that follows taken with regard to the drawing forming a part hereof in which:

FIG. 4 illustrates the operat:on of filling a gravel bag.

FIGS. 5, 6, 7, and 8 are diagramatic sequential views illustrating the closing of the top of a bag filled with gravel.

DESCRIPTION OF A PREFERRED EMBODIMENT

Figure 1:
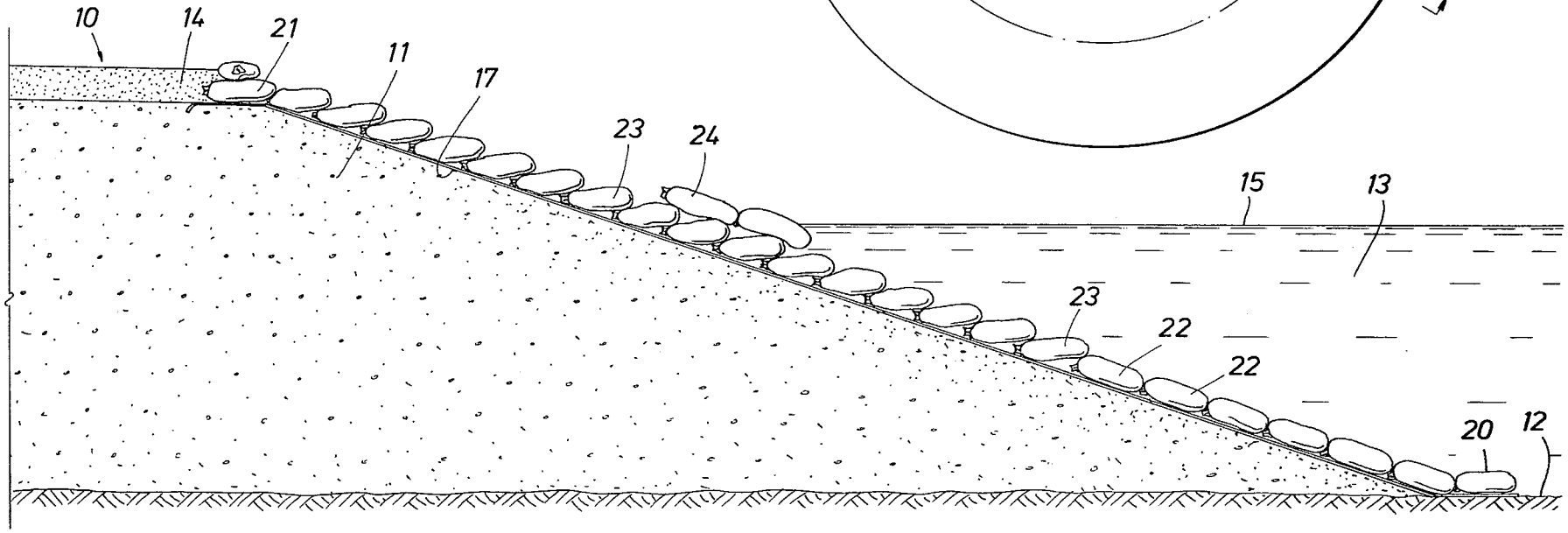
FIG. 1 is a schematic view taken in vertical cross-section of the outer portion of the sand and gravel drilling base or island of the present invention showing that section of the island taken along the line 1—1 of FIG. 2.

Referring to FIG. 1 of the drawing, one cross-sectional portion of an island 10 is shown as comprising a mound of sand and gravel 11 which has been formed or mounded on the bottom 12 of a body of water 13. The top of the island 14 may be hard packed or formed of concrete so as to support heavy drilling equipment.

Figure 2:
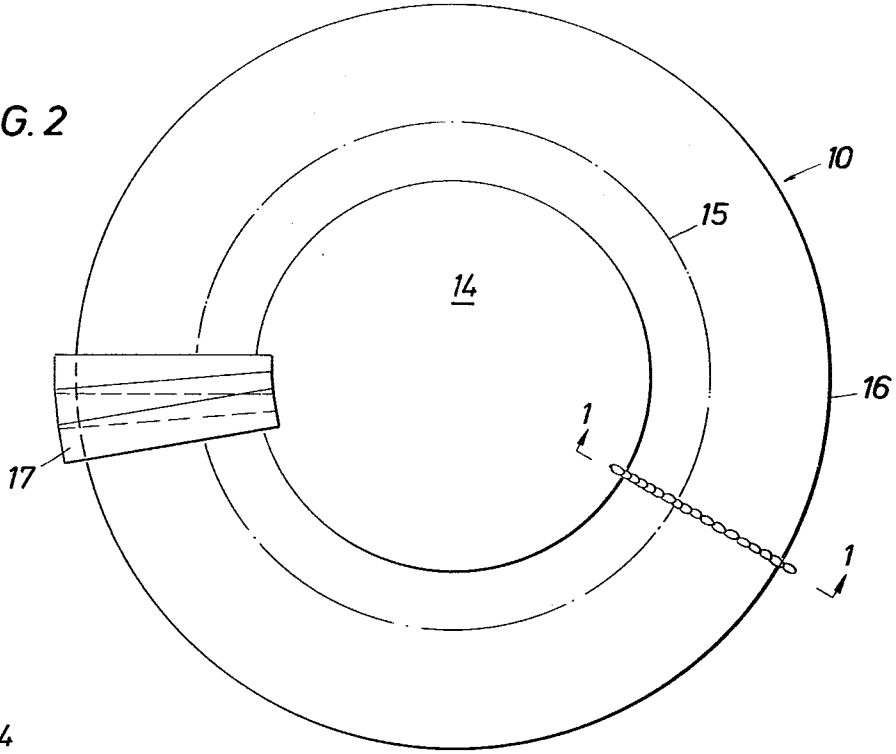
FIG. 2 is a diagramatic plan view of the island of the present invention illustrating the placement of sheets of porous fabric material.

Referring to FIG. 2, the island 10 is shown as having a top surface 14 about 400 feet in diameter with the mean waterline 15 being about 20 feet below the top of the island. In this particular example, the diameter of the island at the base of its sloping sides is about 800 feet, as at line 16.

After forming the island of sand and gravel and mounding the sides to the desired angle, sheets of a porous fabric 17 are laid down along the sloping sides of the island and preferably overlap the top and bottom about 2 to 10 feet as shown in FIG. 1. As previously noted, the sheets of fabric material are preferably made of a plastic that is resistant to the environments in the Alaskan area. The sheets may be of any width, in this example being over 40 feet wide. The sheets of material are laid in a manner as shown in FIG. 2 so that there is, say, a 6 foot overlap of one sheet relative to its adjacent sheet at the bottom of the slope of the island. This is done to reduce the erosion of sand from between adjacent sheets.

The upper and lower ends of this fabric material 17 (FIG. 1) may be anchored at the upper and lower ends of a circumferential row of sand bags 20 and 21, respectively. With the fabric raterial, or at least a portion of the fabric material 17, anchored in a suitable manner, large flexible bags of sand and gravel 22 are laid along the lower portion of the sloping sides of the island below the water level in an end to end and side by side arrangement. As illustrated, the long axis of the gravel bag 22 lies substantially parallel to the slope of the island. From at least the low water level mark to the high water level the bags 23 are arranged in an imbricated manner with the downslope end of each bag 23 overlapping and anchoring the upslope end of the adjacent bag lying downhill thereof. In many cases the overlapping of the bags may start 20 feet or more below the low water level. The amount of overlap selected depends upon the wave and ice conditions to be encountered. Generally, the overlap of the uphill bag is from 20 to 60 percent over the upper end of the downhill bag. If desired, several rows of sacrificial bags 24, extending circumferentially around the island, may be placed up the water line or at a height where ice floes are expected to hit the island.

While any type of a bag may be used to contain the sand and gravel, the bag is preferably made of a strong porous plastic fabric whereby water may enter the sand and gravel at an underwater position so as to displace the air therefrom and g1ve it greater weight and hence greater anchoring power. Additionally, it is most important that the bag be closed in a quick easy manner for handling purposes since it may take 15,000 bags or more for a small island. Additionally, the bag should be adapted to be closed fairly tightly so that the constant action of waves does not wash any of the sand from it through the opening by which the bag was filled. Obviously, while a material porous to water is to be employed, the mesh of the fabric is of a size that the sand and gravel does not pass through it.

Figure 9:
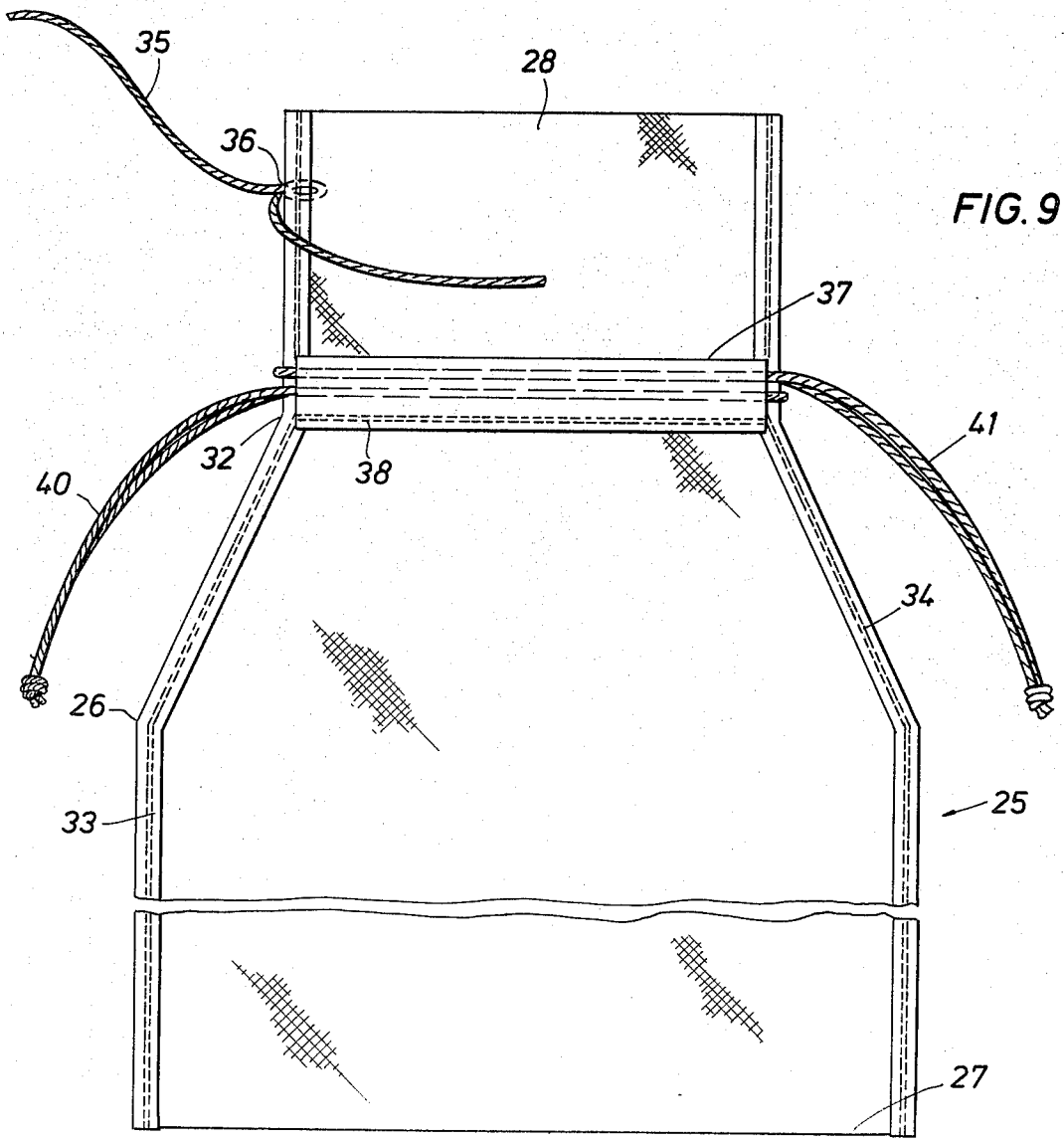
FIG. 9 is a diagramatic view taken in greater detail of the closure means of the top of a bag.

One farm of a bag in accordance with the present invention, is shown in FIG. 9 in its unfilled or flat position. Thus, the bag 25 of FIG. 9 is about 6 feet wide and has an overall length of about 15 feet. The lower end of the bag in its flat position is folded over so as to form a closed lower end 27 while the upper end 28 of the bag is open. The width or diameter of the open end 28 of the bag 25 is of reduced diameter so as to cut down on the amount of material that has to be drawn together to close the open end of the bag. At the same time, the open end 28 of the bag has to be large enough so that the bag can be easily and quickly filled with sand and gravel. As illustrated in FIG. 4, the upper end 28 of the bag has to be large enough to surround the filling spout 30 of a sand and gravel hopper 31. The fill line of the bag 25 (FIG. 9) is about where the bag starts to taper at 26, which may be about 11 feet from the bottom of the bag. From point 26, the upper portion of bag may taper upwardly to the smaller diameter of the upper end of the bag 28 or may taper inwardly from 26 to point 32 and thence upwardly, as illustrated. The sides of the bag are closed in any suitable manner, as by heat sealing or polymerizing, but we preferably double stitched as is indicated at 33 and 34.

The upper open end 28 of the bag 25 (FIG. 9) may be closed as by means of a tiestring 35 which may be wound around the top of the bag after it has been pulled together. Alternatively, a tiestring in the form of a pull strap, or banding material made of plastic or metal may be used. Preferably, the tiestring 35 is secured to the side stitching of the bag, as at 36, so that the operator filling and closing the bag has a drawstring readily available. Since the mass and stiffness of the material being closed by the drawstrings at the top of the bag is so great, it has been found to be impossible to close the top of the bag with a tiestring without leaving as much as a 4 or 5-inch opening through which sand and gravel could be lost from the bag due to the constant pounding of wave action. In view of this, double closures were provided at the top of each bag and a method developed for closing the bag so that no sand or gravel was lost from it except through rupture.

To form a second closure, a pair of open-ended drawcord pockets, one of which is shown at 37, were stitched, as at 38, to both sides of the outside of the bag. The pockets were large enough to permit passing a pair of drawcords 40 and 41 in opposite directions through the pocket 37, around the neck 32 of the bag 25 and through the other pocket on the back side of the bag. Thus, two looped drawcords 40 and 41 were provided extending around the bag in opposite directions so that when the ends of the drawcords 40 and 41 were drawn in opposite directions the neck of the bag would be closed. In some circumstances, the use of a single drawcord may be sufficient. Also, a series of loops or anchoring rings could be used instead of pockets 37.

While the gravel bags may be filled in any suitable manner, one operation is shown in FIG. 4 wherein a bag 25 is shown positioned within a metal container 42 with the upper opened end of the bag 28 surrounding the filling spout 30 of the sand and gravel hopper 31. The operator 43 operates the lever 44 to fill the bag 25 to the desired height. The gravel bag 25 is then closed as illustrated in the sequential steps of FIGS. 5 through 8. In FIG. 5, the small diameter end 28 of the bag 25 has been pulled off the filling spout 30. In FIG. 6, the operator has wound the tiestring 35 around the top of the bag and tied it to close the top of the bag as tightly as possible. The operator then pushes the closed top of the bag and tied string 35 downwardly into the bag to the position shown in FIG. 7. With the upper tied end of the bag pushed downwardly below the drawcord loop 37, the drawcords 40 and 41 are then pulled in opposite directions to close the bag at the elevation of the drawcord loop 37. The drawcords 40 and 41 are then tied together or otherwise secured to prevent their running backward through the drawcord loops.

Thus, it may be seen in FIG. 8 that the sand and gravel bag 25 has been closed twice thus precluding any escape of sand or gravel. In addition, the first closure 35 has been put in an area below the drawcord loop 37 so that it cannot be damaged by handling or acted upon by wave or ice action. Further, the loops 37 provide anchoring means preventing the drawcords 40 and 41 from slipping off the closed end of the bag 25. Obviously, it may be seen that the position of the loop 37 must be at a distance above the normal fill line 45 of the bag so that enough room is provided above the sand in the bag to hold the turned down top of the bag's drawstring 35 and still permit the sides of the bag to be drawn together tightly enough by the drawcords 40 and 41 to effectively close the open end of the bag 25.

Figure 3:
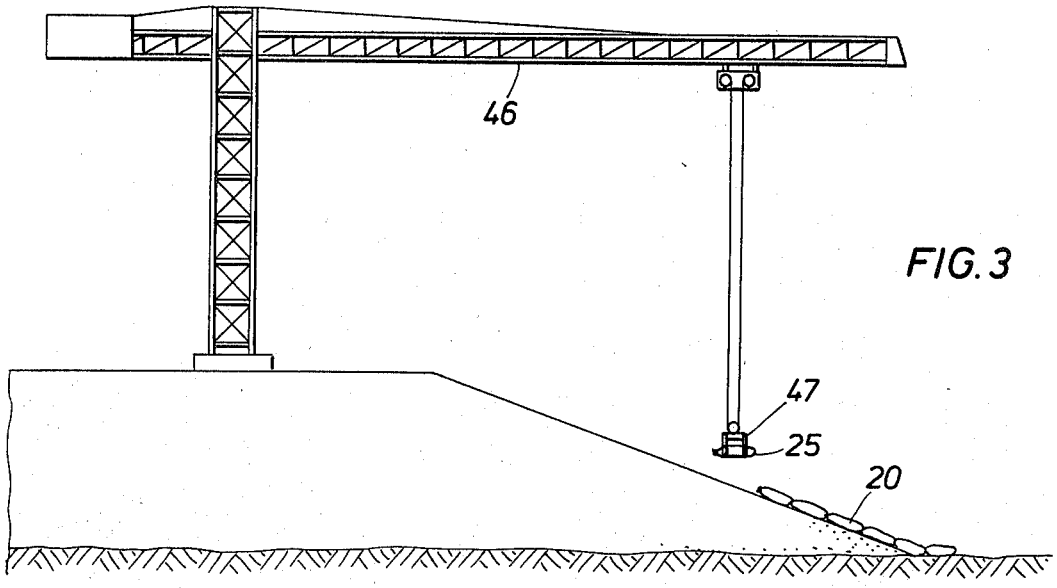
FIG. 3 is a schematic view illustrating equipment placing bags of gravel along the sloping side of the island.

After the sand and gravel bags have been made up to serve as anchoring means for the fabric sheets covering the size of the island, they may be deposited on top of the fabric in any suitable manner. For example, as illustrated in FIG. 3 a crane 46 with lifting tongs 47 is used since each bag may weigh several tons. Further, as shown in FIG. 4, the bag container 42 may be provided with lifting arms 48 and pad eyes 49. The lifting arms 48 are spaced to be engaged by a forklift truck which picks the container and gravel bag up and transports it to a desired location where the can is dumped over on its side and pulled off the bag by means of the pad eyes 49. Any other suitable arrangement of handling bags may be employed and since it does not form part of the present invention no further description will be given at this point.

What is claimed is:

1. An offshore man-made island of a size to drill oil or gas wells therefrom, said island, when taken in vertical cross section, being in the form of a truncated cone having a base at least four times as great as its height, at least the sloping outer surfaces of the island being made of sand and gravel of a size that is subject to erosion by wave action, said island comprising:

a protective erosion-combating covering on the sloping sides of the island in the form of a porous flexible sheet through which water can pass in either direction with minimal disturbance to the sand and gravel forming the island;

said covering extending from the bottom of the island on the ocean floor upwardly along the sides of the island to a level at least equal to that of maximum high tide, said covering comprising a plurality of lengths of flexible sheet material positioned on the sloping sides of the island and extending radially outwardly and downwardly from the top to the bottom of said island;

anchoring means in the form of partially flexible bags of sand and gravel arranged in a pattern to cover the flexible island covering from the ocean floor to a level at least equal to that of maximum high tide;

each of said bags having sides longer than the width of its bottom, said bags being arranged on their sides in rows on the slope of the island with the long dimension of the bags running up the side of the island; and the bags located between the high and low water levels on the island arranged in an imbricated manner with the downslope end of each bag overlapping and anchoring the upslope end of the adjacent bag lying downhill thereof by extending from 20 to 60 percent of the length of the bags over the adjacent downhill bags.

* * * * *